United States Patent [19]

Doi et al.

[11] 4,253,580

[45] Mar. 3, 1981

[54] CONTAINER COVER WITH PEELABLE LINER

[75] Inventors: Koichi Doi, Inuyama; Fumio Mori, Yokohama; Isao Ichinose, Hirayama; Tetsuomi Ogimoto, Komaki; Katsuhiko Kitakawa, Konan, all of Japan

[73] Assignee: Toyo Seikan Kaisha, Ltd., Tokyo, Japan

[21] Appl. No.: 67,308

[22] Filed: Aug. 17, 1979

[51] Int. Cl.[3] ..... B65D 53/04

[52] U.S. Cl. ..... 215/228; 215/230

[58] Field of Search ..... 215/228, 230, 227, 365; 40/311

[56] References Cited

U.S. PATENT DOCUMENTS

| | | | |
|---|---|---|---|
| 4,111,323 | 9/1978 | Ichinose et al. | 215/230 |
| 4,157,143 | 6/1979 | Doi | 215/228 |
| 4,165,009 | 8/1979 | Murayama | 215/228 X |

*Primary Examiner*—Donald F. Norton

*Attorney, Agent, or Firm*—Pennie and Edmonds

[57] ABSTRACT

A container closure for use in packaging flowable materials is disclosed comprising a closure shell, a peelable thermoplastic liner disposed on the inner surface of the shell and having a thick periphery and a comparatively thin central portion with a demarcated peeling tab extending to the periphery of the liner, and at least one adhesive interfacial layer separating the liner from and peelably bonding said liner to the shell and having a non-adhesive or weakly adhesive zone underlying and corresponding to the periphery of the liner and a relatively strongly adhesive zone underlying and corresponding to the central portion of the liner.

10 Claims, 23 Drawing Figures

CONTAINER COVER WITH PEELABLE LINER

DESCRIPTION

1. Technical Field

This invention relates to closures for containers used for packaging flowable materials such as beverages and the like. More particularly it relates to an interiorly lined container cap or cover constructed in such a way that the liner (or packing), formed by press-forming a thermoplastic resin, is bonded to the cap or cover shell so as not to peel off during ordinary handling, but can be peeled off easily with the fingers at the buyer's pleasure without using any special tool or equipment.

2. Background Art

In recent years containers (e.g., bottles) for beverages and the like having interiorly lined caps or covers whose liners are securely bonded to the cap or cover shell but are still peelable have become an essential feature in "prize marketing" of such containers.

Thus, sheet metal having surface protective coatings and formed into shapes suitable for use as container closures such as crown seals or caps with a lining or packing adhered to their inner surfaces are widely used for prize marketing of bottled drinks. This marketing system generally is one whereby, when a purchaser submits the prescribed number of packings or a packing that is identified by a winning designation, or when he submits a crown seal or cap identified by a winning designation printed on the inner surface, he is awarded a prize of some sort. In manufacturing such closures, it is essential that while the packing be easily peelable at pleasure from the crown seal or cap, it is sufficiently bonded thereto so that it will not peel off during manufacture, transport, or packaging (including crimping and roll-on), and that the crown seal or cap have sufficient corrosion resistance to withstand the corrosive effects of the container contents (e.g., carbonated beverages). Furthermore, since it is impermissible from a sanitation standpoint to apply printing ink on any packing surface that comes in direct contact with the container contents, it is highly desirable that the ink layer be applied to the inner surface of the crown seal or cap in such a way that it is either removed by adherence to the packing, or remains on the seal or cap.

Products used as container closures for prize marketing include those in which the closure shell and liner are joined by means of a peelable coating-to-coating interface or a coating-to-liner interface. However, such closures heretofore required a certain minimum degree of adhesive strength between the shell and the liner in order to ensure sufficient sealability and prevent the liner from detaching as a result of vibrations during the transport and capping processes. Because of this, it has been difficult to peel off the liner using one's fingernail, and by having to resort to a peeling implement, there was considerable risk, particularly for children, of accidents and serious injuries resulting from attempts to peel off the liner of the prize crown with such implements.

Because of the aforesaid drawbacks, there has been a long-felt need for a container closure having a liner that will not detach or give poor sealing under ordinary handling, but which will when required, peel off easily with the fingers without need for a peeling implement.

Accordingly, it is an object of the present invention to provide a lined container closure which avoids accidental peeling of the liner from the closure shell but which, when required, allows facile manual peeling of the liner from the shell without using any special implement.

Another object is to provide a peelably lined container closure having an improved liner construction.

These and other objects as well as a fuller understanding of the invention and the advantages thereof can be had by reference to the following description, drawings and claims.

DISCLOSURE OF THE INVENTION

The foregoing objects are achieved according to the present invention by a container closure or cover, such as a crown seal or cap, comprising a shell and a peelable liner applied to the inner surface of the shell. The liner has a thick outer or peripheral portion and a comparatively thin central portion and is formed by press-forming a thermoplastic resin inside the shell. In the central portion of the liner a peeling tab, demarcated by a completely cut line or by a breakable weakened line, is connected to the peripheral portion of the liner. At least one peelable interface is provided between the liner and the shell. The interface has a non-adhesive or weakly adhesive zone underlying and corresponding to the periphery of the liner, and a more strongly adhesive zone underlying and corresponding to the central portion of the liner.

Peeling of the liner from the shell is commenced by pulling the tab, which is preferably of a size sufficient to be held between the fingers. The peeling off of the outer periphery of the liner then commences due to the non-adhesive or weakly adhesive interface between the periphery of the liner and the shell, whereby the peeling of the entire liner is effectively accomplished.

The Shell

The shell of the container closure can be made of steel sheet that has been surface treated with phosphoric acid or chromic acid, or it can be sheet steel that has been surface treated by electrolytic or hot dip plating, e.g., with tin or zinc. Other metal sheet materials can be used, such as aluminum sheet or foil.

To prevent corrosion, the metal container closure shell should be given an initial protective undercoating, e.g., a conventional undercoating with one or more polymeric or copolymeric coatings or primers, including phenol-epoxy paint, epoxy-urea paint, epoxy-melamine paint, phenol-epoxy-vinyl paint, epoxy-vinyl paint, vinyl chloride-vinyl acetate paint, vinyl chloride-vinyl acetate-maleic anhydride paint, acrylic paints, and unsaturated or saturated polyester paints.

The Liner

The liner can be any moldable thermoplastic resin having the requisite cushionability and sealing properties. Suitable thermoplastic resins include olefin resins, e.g., low and medium density polyethylene, ethylene-butene-1 copolymer, ethylene-hexene copolymer, ethylene-propylene copolymer, and ethylene-propylene-nonconjugated diene terpolymer, or functionalized (i.e., modified) polyolefins or olefin copolymers containing mainly olefin with small additions of ethylenically unsaturated monomers other than olefins. Such functionalized polyolefins include ethylene-vinyl acetate copolymers, saponified ethylene-vinyl acetate copolymers, ethylene-acrylic acid copolymers, ethylene-methylmethacrylate copolymers, unsaturated carboxylic acid denatured or modified polyethylene (in which maleic acid, acrylic acid, methacrylic acid and their esters can serve as the unsaturated carboxylic acid constituent), unsaturated carboxylic acid modified polypropylenes, soft vinyl chloride resin compositions, ionomers, and polyethylene chlorosulfonate. These olefin resins can be used singly or in combinations of two or more, and to improve the required elastic properties of the liner as a packing or sealant, the foregoing resins can be blended with one or more elastomers in amounts of 1 to 60 weight percent. Such elastomers include ethylene-propylene, ethylene-propylene-diene rubber, polyisobutylene, butyl rubber, polybutadiene, natural rubber, stereospecific polyisoprene-nitrile rubber, styrene-butadiene copolymer, or polychloroprene. Conventional blends with phenols, organosulfur compounds, organonitrogen compounds, organo-phosphorus compounds and the like as antioxidants or heat stabilizers, with lubricants such as metallic soaps and other fatty acid derivatives, and with fillers or colorants such as calcium carbonate, white carbon, titanium white, magnesium carbonate, magnesium silicate, carbon black and various types of clay, can also be formulated for use in the present invention.

The olefin resins suitable for use as a liner material can also accept cross-linking, bridging or foaming agents singly or in combination. For example, when forming an olefin resin coating having superior heat resistance and mechanical properties (e.g., durability or elasticity) over a metal base, it is desirable to add cross-linking agents to the resin, and when forming a coating having the requisite cushioning properties, it is desirable to add foaming agents to the resin, along with cross-linking agents as required. Suitable cross-linking agents are those that dissolve at a temperature close to the processing (softening) temperature of the resin used, e.g., organic peroxides such as dicumyl peroxide, di-t-butyl peroxide, cumyl hydroperoxide, and 2,5-dimethyl-2,5-di(t-butylperoxy)hexene-3. Suitable foaming agents are likewise those that dissolve at a temperature near the processing temperature of the resin, e.g., 2,2-azo-bisisobutyronitrile, azodicarbonamides and 4,4-oxybisbenzenesulfonyl hydrazide. The cross-linking agents are used in amounts of 0.1 to 5 weight percent of the resin, and the foaming agents are used in amounts of 0.2 to 10 weight percent of the resin.

The Adhesive Layer

Adhesives suitable for use in the present invention are those capable of peelably bonding the aforesaid liner to the container closure shell. In particular, when the liner is made from an olefin resin, a coating of polyethylene oxide and carboxylic acid-modified olefin resin dispersed in a coat-forming base resin can be used. When the liner is made from a vinyl chloride resin, the adhesive layer can be a coating derived from a combination of vinyl chloride resin or acrylic resin with a heat-curable (thermoset) resin such as epoxy resin, phenolic resin, amino resin or alkyd resin.

With respect to adhesive coating layers for use with olefin resin liners, the acid denatured olefin resin and the polyethylene oxide adhesives for the olefin resin are distributed on the interface between the undercoating and the liner. For the purpose of forming the aforementioned peelably adhesive bond, the concentrations of polyethylene oxide and acid modified olefin resin should provide between about 0.01 and about 200 meq of carbonyl (—CO—) radical per 100 g of total polymer, and the degree of crystallinity should be at least 50% and preferably 70% or more.

Suitable acid denatured or modified olefin resins can be any of those heretofore known that fulfill the foregoing conditions, and include those that will induce main chains or side chains of olefin resins in olefinic unsaturated carboxylic acids or their anhydrides by means such as graft copolymerization, block copolymerization or terminal treatment. Suitable monomers include acrylic acid, methacrylic acid, maleic acid, fumaric acid, crotonic acid, itaconic acid, citraconic acid, 5-norbornene-2,3-dicarboxylic acid, maleic anhydride, citraconic anhydride 5-norbornene-2, 3-dicarboxylic anhydride and tetrahydropthalic anhydride.

The polyethylene oxides used in the present invention can be any of those heretofore known which fulfill the foregoing conditions, including the so-called polyethylene oxides obtained by oxidizing copolymers having polyethylene or ethylene as their main constituents, in the molten or dissolved state as required.

Suitable coat-forming base resins include conventional resins used to form primer layers and having anti-corrosion properties. The ratio of the concentration of coat-forming base resin to the concentration of denatured or modified olefin resin is desirably at least about 1.1, and preferably in the range of 1.2 to 1.3. The resin-modifying functional group can be hydroxyl groups and/or carbonyl groups and these should be in concentrations of at least 1 meq/g and preferably 3 meq/g to 20 meq/g, from the standpoint of controlling the distribution of the olefin resin in the adhesive layer. Suitable base resins include both heat curable and thermoplastic resin vehicles that are widely used in the field of coatings, e.g., thermosetting resins including one or more phenol-formaldehyde resins, urea-formaldehyde resins, melamine-formaldehyde resins, xylene-formaldehyde resins, epoxy resins, alkyd resins, urethane resins, and polyester resins; and thermoplastic resins such as acrylic resins, vinyl chloride-vinyl acetate copolymers, vinyl chloride-vinyl acetate-maleic acid copolymers, vinylbutyral resins, styrene-butadiene-acrylic copolymers, polyamide resins and petroleum resins.

The foregoing polyethylene oxide/modified olefin resin component (A) and the coat-forming base resin (B) can be employed in weight ratios of A:B=0.2:99.8 to 70:30 and preferably 1.99 to 30:70.

Peelable adhesive coating layers suitable for use with vinyl chloride resin liners can be formulated from an acrylic resin or from a vinyl chloride resin (C) such as polyvinyl chloride, vinyl chloride-vinyl acetate copolymer, vinyl chloride-vinyl acetate copolymer partially saponified or acetylated, or vinyl chloride-vinyl acetate-maleic anhydride copolymer, blended or precondensed with thermoplastic resins such as epoxy resins, phenolic resins, amino resins and alkyd resins (D), in weight ratios of C:D=30:70 to 98:2 and preferably 50:50 to 90:10.

By increasing the proportion of thermoplastic resin in the adhesive coating, the adhesion of the vinyl chloride resin liner to the closure shell is weakened.

The adhesive layer can be applied by any convenient method such as dipping, spray painting, roller coating, bar coating, electrostatic painting and electrodeposit painting. Alternatively, the adhesive layer can be applied in the form of printing inks by relief printing, intaglio printing, screen printing, flat press printing and offset printing.

The solvents used to dissolve or disperse the adhesive resin formulation can be one or combinations of two or more solvents such as ketones, e.g., acetone, methylethyl ketone, methylisobutyl ketone, cyclohexanone; alcohols such as diacetone alcohol, n-butanol, methyl cellosolve, and butyl cellosolve; toluene; xylene; and decalin. The concentration of adhesive resin solids in the paint or ink should be in the range of 5 to 50% by weight.

Generally, the amount of adhesive coating applied to the shell can be up to 500 mg/dm$^2$ and preferably up to 100 mg/dm$^2$ (measured as resin solids concentration). In the case of adhesives containing polyethylene oxide and denatured olefin resins, the coating should be carried out to the extent of 0.01 to 100 mg/dm$^2$, and preferably 0.1 to 10 mg/dm$^2$.

In one embodiment of the present invention, the binding strength of the adhesive layer can be varied by constructing the peeling interfaces as pluralities of adhesive layers. For example, in order to vary the adhesive strength at the interface between the adhesive layer and the liner, one can apply an adhesive paint containing a comparatively small amount of polyethylene oxide or acid denatured olefin resin in the region corresponding to the periphery of the peelable liner, while applying an adhesive paint containing a comparatively large amount of polyolefin oxide or acid denatured olefin resin in the region within the periphery. By thus varying the distribution of polyethylene oxide and acid denatured olefin resin on the surface of the adhesive layer in the manner described, a nonadhesive or weakly adhesive zone is formed in the region corresponding to the periphery of the liner, and a stronger adhesive zone is formed within the periphery. The same objective can be achieved by applying a vinyl paint containing a comparatively large amount of thermoplastic resin in the region corresponding to the periphery of the liner, and applying a vinyl paint containing a comparatively small amount of thermoplastic resin inside this region.

However, from the standpoint of workability and ease of processing the container cover during manufacture, it is advantageous to vary the distribution of the ingredients in the adhesive that impart adhesion with the liner, for example, polyethylene oxide or acid denatured olefin resin, between the non-adhesive or weakly adhesive zones and strongly adhesive zones, and to distribute them in greater concentrations in the said strongly adhesive zone than in the nonadhesive or weakly adhesive zone.

Control of the polyethylene oxide or acid denatured olefin resin distribution on the adhesive coating can most easily be accomplished by applying at least one masking layer containing a distribution control agent such as an oily resin between the adhesive layer and the closure shell. This is described in detail below and illustrated in FIG. 5 of the drawings.

The Masking Layer

In one aspect of the present invention, a composition can be used to control the distribution of the modified olefin resin component of the adhesive layer. Such a distribution control agent can be any substance which exhibits chemical or physical reciprocal action upon the modified olefin resin. Examples of such substances are as follows:

(1) Oily resins or oil-modified resins. These resins contain as at least one of their ingredients drying oils such as linseed oil, tung oil, perilla oil or dehydrated machine oil, semi-drying oils such as rubber oil, soybean oil, rape seed oil and cotton seed oil, or non-drying oils such as tsubaki oil, olive oil, castor oil and palm oil, or resins denatured with these oils, e.g., oil-denatured alkyd resin, oil-denatured epoxy resin, oil-denatured phenol resin, oil-denatured amino resin, oleoresinous paint, oil-dentured polyamide resin, oil-denatured acrylic resin and oil-denatured vinyl resin, either singly or in combinations of two or more.

Although there are no particular restrictions on the degree of denaturation of the oil, it is preferred to employ the above mentioned drying oils, semidrying oils and non-drying oils present in amounts of 15 to 85 weight percent of the total resins.

(2) Resins having fatty acids or polymerization resin acids as their constituent ingredients, e.g., polyamide resins having polymerization acid as a constitutent ingredient, and various resins denatured with linolic acid, linolenic acid and dehydrated castor oil fatty acid.

(3) Polyalkylene polyols, e.g., polyethylene glycol, polypropylene glycol, and ethylene oxide additives such as polyhydric alcohol, aliphatic amines and fatty acid amides.

(4) Fatty acid metallic soaps, e.g., calcium stearate.

(5) Organosiloxanes, e.g., dimethylpolysiloxane.

(6) Butadiene paints, e.g., boiled denatured polybutadiene glycol.

The distribution control agents suitable for use in the present invention are not limited to the examples shown above. For instance, when epoxy plasticizers such as epoxied soybean oil, phthalate ester plasticizers such as DOP, and polyester plasticizers are contained in the masking layer as distribution control agents, there is found to be substantial action in preventing the appearance of excessive distribution structures in the denatured olefin resins of the adhesive layer. This is believed to be due to the shifting of the plasticizer in the masking layer into the adhesive layer, whereby the denatured olefin resin is distributed uniformly in the primer layer.

Thus, the term distribution control agent as used herein includes not only substances that inhibit the excessive distribution of denatured olefin resins by static attraction and by chemical affinity to or reactivity with the olefin resins, but also those that modify the dispersability of the denatured olefin resins within the coat-forming base resin in the adhesive layer.

In the present invention, when the distribution control agent itself has coat-forming ability, it can be used alone as a masking layer on the metal base, or it can be painted on the metal base in admixture with another coat-forming base resin.

The amount of distribution control agent employed will depend on the type, but ordinarily the range of 1 to 300 mg/dm$^2$ or more, and particularly 2 to 150 mg/dm$^2$, will be suitable for purposes of the present invention. When applied in combination with the coat-forming base resin, the overall amounts of application should be 10 to 500 mg/dm$^2$, and preferably 20 to 200 mg/dm$^2$.

These masking layers will ordinarily be applied on the metal base in the form of paint or ink dissolved in suitable organic solvents, and with various types of coaters or printers.

These masking layers can be applied on the metal base in any desired geometric shape, for example, in point networks, rings, radials, concentric circles, circles, squares or triangles, or in any combination thereof.

These masking layers are used in applications of the adhesive paints hereinbelow, in wet form as painted or printed, or in dried or hot painted form.

In the present invention, in order to distribute the polyethylene oxide and acid denatured olefin resin in the paint primarily on the coat layer surface, means that are themselves well known, for example as disclosed in U.S. Pat. No. 4,062,997, can be used.

The forming of the container closure shell can be readily accomplished by press forming, stamping and drawing processes using sheets of metal material previously provided with undercoating paint, printing layers and adhesive paint layers on its surface.

Formation of the liner can be accomplished by supplying a quantity of molten olefin or vinyl chloride resin to the inner side of the shell, and then pressing after cooling with a stamper. It is also possible, instead of using molten resin, to supply cooled resin to the inner surface of the shell and then melt it by heating. Also, it is possible to supply vinyl chloride resin to the inner surface of the shell in the form of a so-called plastisol, press with a heated stamper, and do gelation simultaneously with forming.

Brief Description Of The Drawings

A further understanding of the invention and its advantages can be had by reference to the accompanying drawings, wherein.

DESCRIPTION OF PREFERRED EMBODIMENTS

Figure 1:
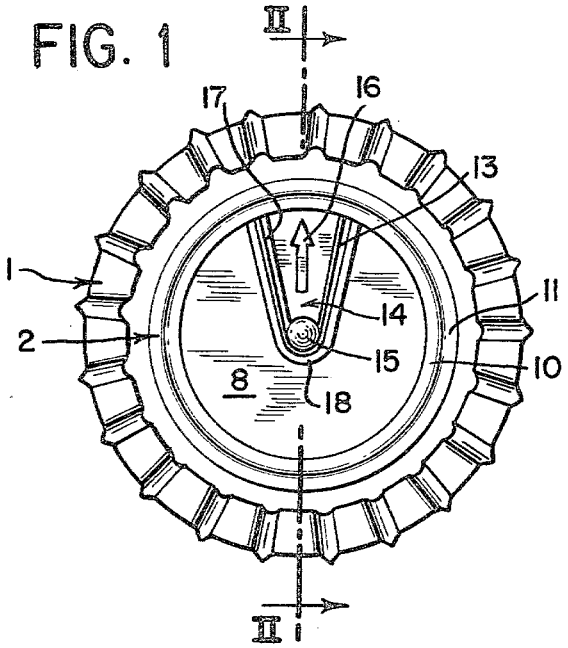
FIG. 1 is a vertical plan view of the underside of an embodiment of the container closure of the present invention in the form of a crown cap.
Figure 2:
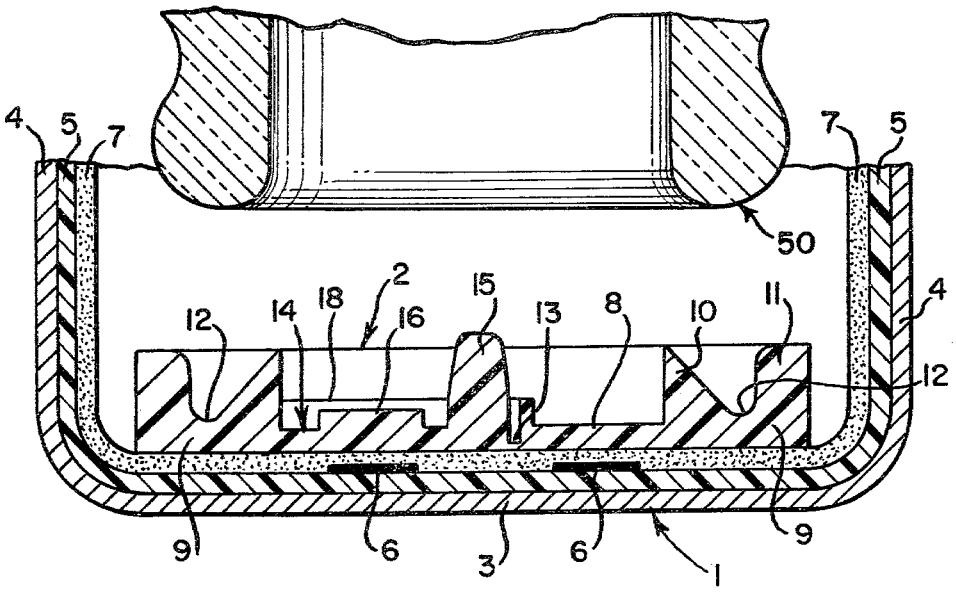
FIG. 2 is an enlarged cross-sectional view through center line II—II of the container cover of FIG. 1 in position for application to a container opening.

Referring now to the drawings, wherein like parts or elements in different figures are denoted by the same numeral, FIGS. 1 and 2 illustrate the container closure of the invention in the form of a crown comprising shell 1 and liner 2. Shell 1 is made of top portion 3 and skirt 4, the latter extending at a generally right angle from the periphery of top portion 3 and provided with conventional corrugation suitable for crimping around container (e.g., bottle) mouth 50. Shell 1 is made of a conventional material, and its inner surface is coated with corrosion resistant protective undercoating 5 and, when required, has prize-indicating print layer 6 formed on top of the undercoating. On top of protective coating 5 and print layer 6, there is applied an adhesive interfacial layer 7 for bonding press-formed liner 2 to undercoating 5.

Liner 2 is made by press-forming a thermoplastic resin inside shell 1, the liner being bonded to shell 1 by adhesive layer 7. Liner 2 is comprised of comparatively thin central portion 8 and thick peripheral portion 9. At least one part of peripheral portion 9 is in the form of an outer annular projection 11 for fluid-tight sealing engagement with the outer periphery of container mouth 50; another part of peripheral portion 9 is in the form of an inner annular projection 10 which engages the inner periphery of container mouth 50. Concave annular channel 12 between projections 10 and 11 engages the leading edge of container mouth 50.

Central portion 8 of liner 2 is comprised of a peeling tab 14 demarcated by means of a completely cut line or, alternatively, as shown, a breakable weakened line 13 connected to thick peripheral portion 9. As used herein the term "completely cut line" means that the line which demarcates tab 14 and the rest of central portion 8 is a line that is completely cut into adhesive layer 7 and undercoating 5, while the term "weakened line" or "line of weakness" means a demarcation line which is made by scoring or perforating or a combination thereof so that breakage along the line is easily effected.

Peeling tab 14 should be capable of being peeled off in a width comparatively narrower than the central portion of liner 2 and should be large enough to be easily grasped with the fingers when peeling off the entire liner. Thus, demarcating line 13 can be formed in any desired shape such as V-shape, U-shape, square-shape, S-shape and Z-shape.

In order to start the initial peeling of tab 14 effectively, it is advantageous to provide knob 15 projecting in a perpendicular direction to the crown sheet from the tip of tab 14. In this way, when knob 15 is pushed toward the peeling direction of tab 14 (the direction of arrow 16 in FIG. 1) by the fingertip or fingernail, the knob becomes a lever, making it easy for peeling to progress at the adhesive interface. Knob 15 can have any desired shape such as cylindrical, semicylindrical or angular, although for purposes of formability (mold release), it is preferred that it have a conical shape.

In order to prevent tab 14 from being prematurely torn from liner 2 and to facilitate peeling, the tab can be provided with comparatively thick reinforcing ribs extending toward thick outer peripheral portion 9 along the inside of demarcation line 13. In the embodiment shown in FIGS. 1 and 2 knob 15 and arrow 16 serve as reinforcing ribs. Also, in the case where demarcation line 13 is a weakened line, it is possible to furnish relatively thick reinforcing ribs 17 inside and parallel to such line so that the breaking of liner 2 upon pulling off tab 14 will occur only in the line of weakness, rather than in the tab after being separated from the line of weakness. In addition, it is also possible, in conjunction with inner ribs 17, to furnish thick reinforcing ribs 18 outside and parallel to the line of weakness to protect the latter from accidental breakage and to further ensure that breakage will occur in the line of weakness during peeling of tab 14.

Figure 5:
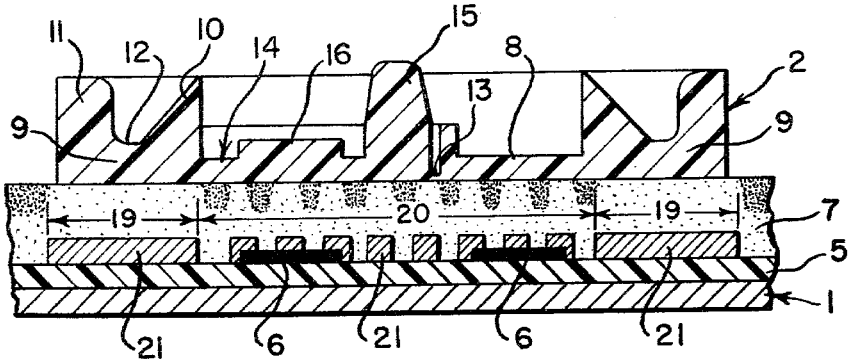
FIG. 5 is an enlarged partial cross-sectional view through line II—II of the container of FIG. 1 which differs from that shown in FIG. 2 in the use of a masking layer to control the distribution of the modified olefin resin component of the adhesive layer in the peelably adhesive interface between the liner and the top inside portion of the container cover shell.

In the embodiment shown in FIGS. 1 and 2, the peeling interface is between liner 2 and adhesive layer 7, and in this peeling interface there is furnished a nonadhesive or weakly adhesive zone 19 underlying the peripheral portion of the liner as shown in FIG. 5 and described hereinbelow, and more strongly adhesive zone 20 underlying the central portion of the liner. Zones 19 and 20 are distributed in the aforementioned pattern so that liner 2 will be joined at all points to shell 1 firmly enough to prevent accidental peeling, not only during transport and capping of the cover, but also while the container is sealed, while on the other hand, when the liner is purposefully peeled from the shell, a tear or gap will form at a predetermined interface between shell 1 and liner 2 to facilitate peeling.

By providing a narrow peeling tab 14 using a cut line or line of weakness in the central portion of liner 2, even when the liner and shell 1 are strongly adhered in the liner central part or the part adjoining, the peeling of the liner will start easily from the single edge of the comparatively narrow tab. When knob 15 of tab 14 is pulled, since the peripheral region of the interface is nonadhesive or weakly adhesive, peeling will start easily from the outer edge of the entire liner, and pulling up of the entire surface will proceed smoothly. In this case, because the outer edge of liner 2 is formed as a thick reinforced part, even when tab 14 is pulled forcefully, breaking of the latter will be prevented, and peeling from the outer edge of the liner will proceed easily.

Figure 3A:
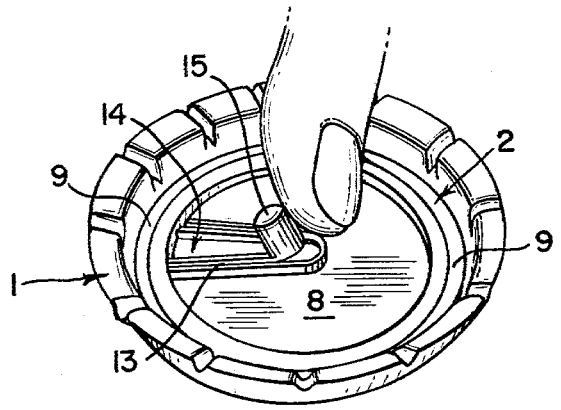
FIGS. 3A–3C are perspective views showing in sequence the steps involved in opening the container cover of FIG. 1.
Figure 3B:
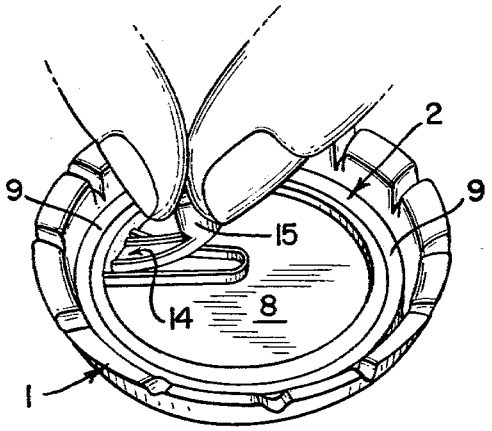
Figure 3C:
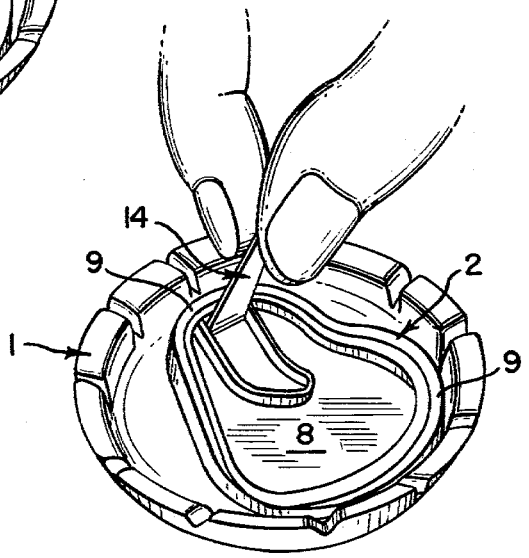

FIGS. 3A to 3C illustrate the peeling off of liner 2 wherein knob 15 is pushed with the fingertip in the peeling direction of tab 14 (i.e., to the left in FIG. 3A), so that the knob becomes in effect a lever, and peeling at the interface between the adhesive layer and liner 2 starts easily (FIG. 3A). Then, as shown in FIG. 3B, when the end of tab 14 (i.e., knob 15) is grasped with the fingertips and pulled in the peeling direction or in a generally upward direction, breaking of line of weakness 13 and peeling of tab 14 proceed right up to thick peripheral portion 9 of liner 2. Finally, as shown in FIG. 3C, when tab 14 is grasped and pulled upward and in the direction opposite the previous peeling direction, peeling of the periphery of liner 2 from shell 1 commences and removal of the entire liner 2 proceeds easily. Thus, the peeling direction of tab 14 from the center to the outer periphery and the subsequent peeling direction of the entire liner 2 are opposite to one another, and the removal of liner 2 from the shell proceeds easily and without the need for any special implement. This, and the fact that peripheral 9 portion of liner 2 has a dual role, namely, that of a sealing cushion and a peeling reinforcer, are characteristic features of the present invention.

The peelable interface, as shown in FIG. 2, can be formed between liner 2 and adhesive layer 7, between adhesive layer 7 and undercoating 5, or between two types of undercoating layers. In addition, two or more peelable interfaces as described above can be provided, and peeling can be made to occur at separate interfaces between nonadhesive or weakly adhesive zones and zones which more are strongly adhesive.

When the peelable interface is formed between liner 2 and adhesive layer 7, the adhesive strength of each part can be adjusted in several ways. For example, by applying an adhesive centrally on the inner surface of shell 1 and not in the region corresponding to the periphery of liner 2, it is possible to form a nonadhesive zone and an adhesive zone in a simple manner. Such an adhesive must be a so-called "peelable adhesive", i.e., one whose overall peeling strength is from 0.02 to 5 kg/cm, preferably from 0.05 to 3 kg/cm. Alternatively, an adhesive can be painted onto the entire inner surface of the shell 1 and a nonadhesive masking layer provided against liner 2 preferentially in the region corresponding to the periphery of the liner.

Applying the foregoing concepts, it is also possible to form a plurality of zones having any desired adhesive strength. Thus, the adhesive strength can be regulated by applying the adhesive layer in a network or pattern of points by methods such as printing, with the points being distributed more densely in the zone intended to be strongly adhesive than in the zone intended to be more weakly adhesive. It is also possible to apply the adhesive layer uniformly, and then adjust the adhesive strength by applying a masking layer in a network of points. The density of the adhesive point network, i.e., the ratio of the area of the overall adhesive zone to the total area, can vary from zero for a nonadhesive zone up to 100% for a strongly adhesive zone. For example, selections appropriate to the adhesive strength desired can be made with strongly adhesive zones of 80% or more, weakly adhesive zones of 30% or less, and medium adhesive zones of 30 to 80%. When the adhesive layer is applied in a pattern of points, greater effectiveness can be achieved from the standpoint of the peeling operation compared to the case where the liner is joined by means of a uniform adhesive layer, because the force needed for peeling can be more easily controlled within prescribed values. When the thick peripheral portion of the liner forms an annular projection for sealing engagement with the container mouth, it is desirable from the standpoint of a long-lasting seal to apply the liner with a strong adhesive at the peelable adhesive interface corresponding to the outer peripheral portion and the portion adjoining it and from this standpoint, it is preferred that the inside boundary of the nonadhesive or weakly adhesive zone of the farthest outward peripheral part of the liner be positioned outside the inner peripheral liner of the annular projection. Also, when a non-adhesive zone is provided in the farthest outward peripheral part of the liner, it is desirable from the standpoint of a long-lasting seal that there be a zone of higher adhesive strength than the central portion, with such more adhesive zone adjoining the non-adhesive part.

Figure 4A:
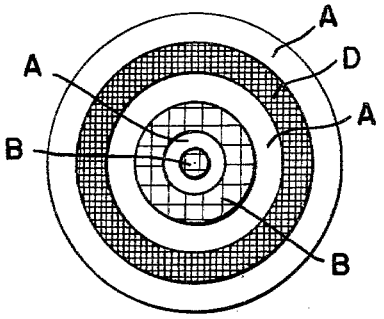
FIGS. 4A–4N are schematic representations of various exemplary strength distribution patterns in which the adhesive interfacial layer can be applied to the top part of the container cover shell.
Figure 4B:
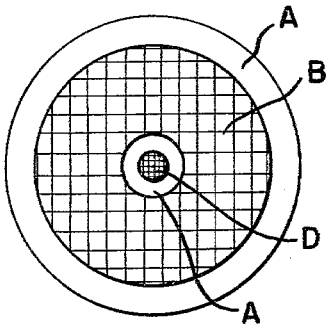
Figure 4C:
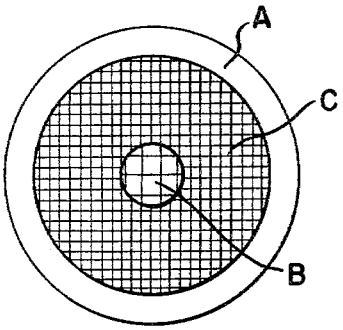
Figure 4D:
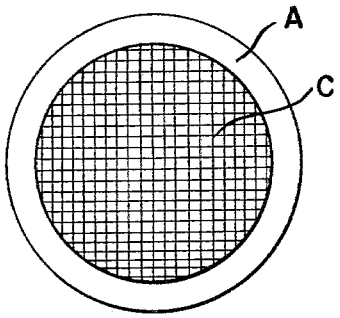
Figure 4E:
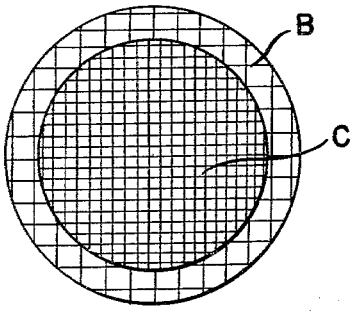
Figure 4F:
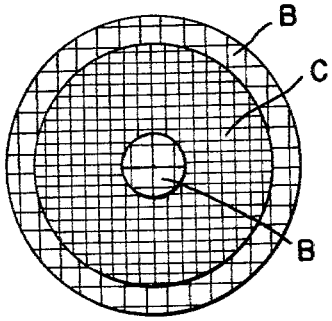
Figure 4G:
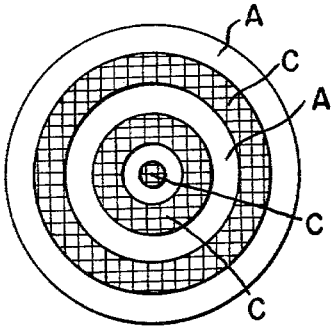
Figure 4H:
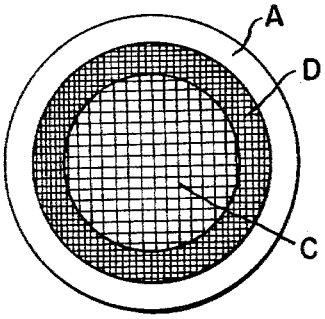
Figure 4I:
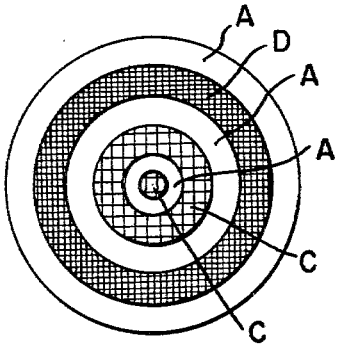
Figure 4J:
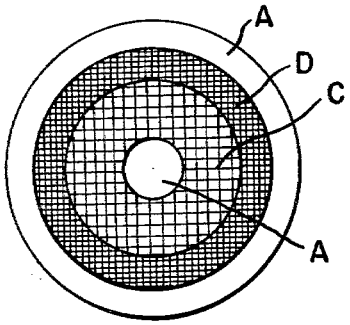
Figure 4K:
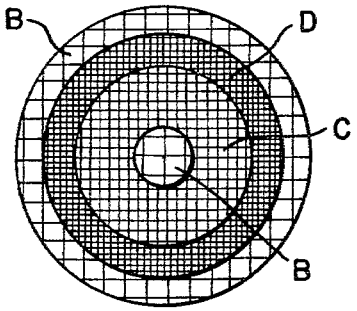
Figure 4L:
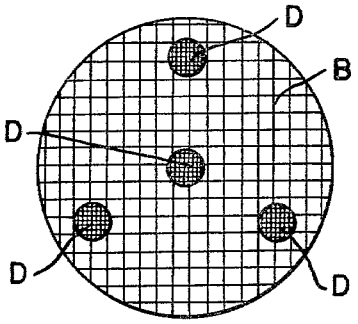
Figure 4M:
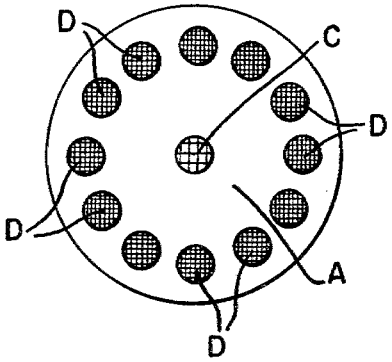
Figure 4N:
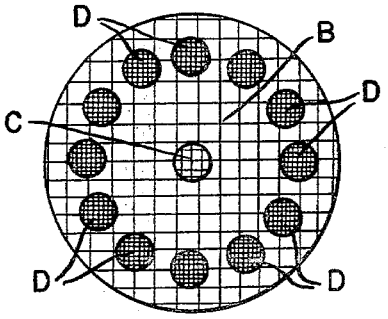

FIGS. 4A to 4N illustrate a number of patterns in which the adhesive layer can be applied as a network of points. The features in the drawings indicate relative adhesive strengths as follows:

A: Nonadhesive zone
B: Weakly adhesive zone
C: Medium adhesive zone
D: Strongly adhesive zone From the foregoing, it is seen that the adhesive zones can be arranged in any desired pattern so long as they fulfill the conditions that there be nonadhesive or weakly adhesive zones in the most peripheral parts, and that adhesive zones stronger than these be present inside. From the standpoint of a long-lasting seal for container closures such as crowns, it is preferred that the outer peripheral nonadhesive or weakly adhesive zones A and B in FIGS. 4A to 4N be dimensioned so that their internal diameters are at least about equal to or longer than the diameters of the thick portions of the peripheries of the liner. Zones of stronger adhesiveness provided inside these non-adhesive or weakly adhesive zones can be in circular form as in FIGS. 4D and 4E, or in rings as shown in FIGS. 4A, 4B, 4C, 4F, 4G, 4H, 4I, 4J and 4K. In the latter case, as shown in FIGS. 4A, 4B, 4G and 4I, it is possible to arrange non-adhesive zones or weakly adhesive zones further inside the stronger adhesive zones to further facilitate peeling. As shown in FIGS. 4C, 4J, 4F and 4K, it is possible to make it easier to start peeling tab 14 by pushing over knob 15 by making the central portion corresponding to knob 15 a nonadhesive zone or weakly adhesive zone, and, as shown in FIG. 4B, forming a strongly adhesive zone in the central portion makes it possible to increase the temporary adhesiveness to the liner-forming resin supplied inside the seal. In this case, a nonadhesive zone of small diameter can be provided around the strongly adhesive zone in order to make tab peeling easier.

As shown in FIGS. 4L, 4M and 4N, the strongly adhesive zone furnished inside the nonadhesive or weakly adhesive zone need not be in circular or ring form, but can be in the form of points arranged at intervals.

FIG. 5 depicts an embodiment of the present invention whereby the distribution of adhesive layer 7 between liner 2 and undercoating 5 is controlled by furnishing a masking layer 21, containing a distribution control agent, between the adhesive layer and the shell. In particular, print layer 6 is formed on the inner surface of the protective undercoating paint layer 5 of metal shell 1, and masking layer 21 containing a distribution control agent such as an oily resin is provided. Over this masking layer 21 is painted adhesive paint layer 7 containing polyethylene oxide or acid denatured olefin resin, and by means of such adhesive layer, the olefin resin liner 2 is adhered to the shell by heating.

Masking layer 21 is furnished as a uniform layer in the parts underlying the thick outer periphery 9 of liner 2, but is also furnished in the form of a network of points inside the periphery. For reasons which are not yet understood, the distributed control agent contained in masking layer 21 controls the way the polyethylene oxide and acid denatured olefin resin in the adhesive layer 7 distribute themselves on the layer surface part. Thus, since virtually no polyethylene oxide and denatured olefin resin are distributed on the surface of adhesive layer 7 in those parts corresponding to the outer periphery of the liner where masking layer 21 has been furnished, nonadhesive or weakly adhesive zones 19 are formed between liner 2 and adhesive layer 7.

In FIGS. 2 and 5, print layer 6 indicating, e.g., a prize marking, is furnished between container cover shell 1 and the peelable adhesive layer 7, and when liner 2 is peeled, this printed layer 6 remains on the container cover shell. However, it is also possible to apply print layer 6 indicating the prize marking between peelable adhesive layer 7 and liner 2, by using a substance having a greater affinity for adhesive layer 7 than for liner 2 as the print layer 6, thereby having print layer 6 remain on the shell when the liner is peeled. Alternatively, it is possible to use a substance having greater affinity for liner 2 than for adhesive layer 7 as print layer 6, thereby having printing layer 6 remain on liner 2 when the latter is peeled. Also, when a peelable interface is furnished between adhesive layer 7 and undercoating paint layer 5, or when a peelable interface is furnished between two types of paint layers, by applying print layer 6 on the upper- or underside of the peelable interface, the print layer will remain on liner 2 when the latter is peeled, or it will remain on shell, as the case may be.

Figure 6:
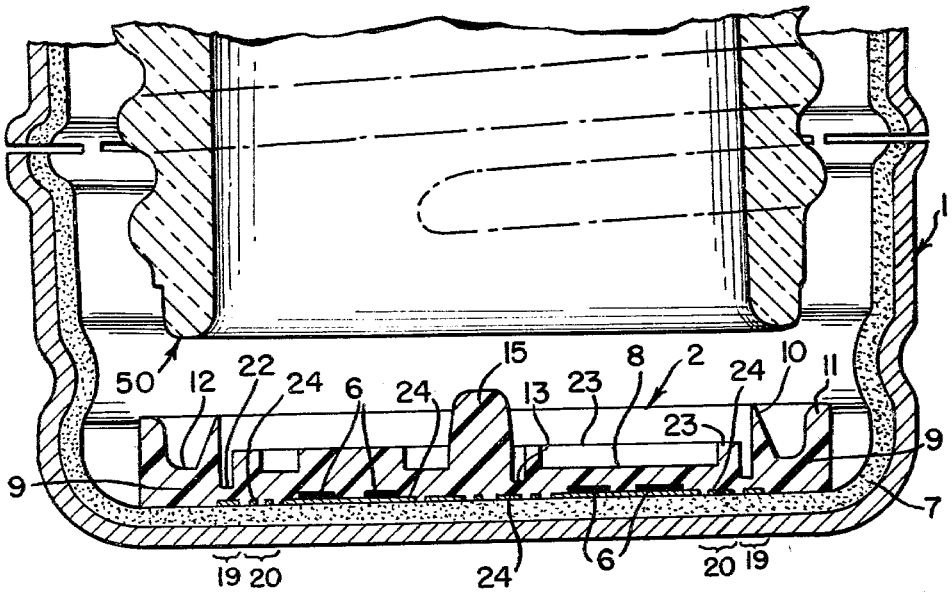
FIG. 6 is an enlarged cross-sectional view through the center-line of another embodiment of the container cover of the invention in position for application to a container opening and wherein the print is transferred to the liner.

FIG. 6 depicts a container closure of the present invention which can be used for resealing the mouth of the container. In liners for this type of closure, the thick peripheral part is constructed of an annular projection 11 used for sealing that engages with the container mouth 50 and a circular reinforcing rib 10 inside said annular projection furnished by means of a completely cut line or a breakable line of weakness 22, and peeling of liner 2 occurs only in the parts inside of the circular completely cut line or line of weakness, so that the annular projection used for sealing that engages with the container mouth remains adhered to the shell. In a cap as the one shown in FIG. 6, the outer peripheral thick part of liner 2, comprising a soft vinyl chloride resin for example, is made up of annular projections 10 and 11 and concave channel 12 for sealing and engaging with container mouth 50, and of peripheral reinforcing rib 23 furnished along circular line of weakness 22 inside the annular projections. Liner projections 10 and 11 and concave channel 12 adhere firmly and unpeelably to adhesive layer 7 (a vinyl chloride resin paint, for example) on the inner surface of cap seal 1. In the periphery 9 of peelable liner 2, the part of adhesive layer 7 corresponding to the peripheral reinforcing rib 23 is painted all over with masking layer 24 (an alkyd resin layer, for example) which is non-adhesive or weakly adhesive to liner 2, and forms nonadhesive or weakly adhesive zone 19. On the inside of this nonadhesive or weakly adhesive zone 19, masking layer 24 is applied in a network of points of adhesive layer 7, forming zone 20 which is more strongly adhesive than the aforesaid. Print layer 6 showing the prize markings is applied on masking layer 24, and adheres to liner 2 but not to masking layer 24. Furthermore, reinforcing rib 23 can be applied annularly along the entire periphery inside the thick part used for sealing, and it can also be applied peripherally only in the vicinity of the base of the tab. Peeling of liner 2 is done by the operations illustrated in FIGS. 3A to 3C, but here, however, by pushing down knob 15 to begin peeling off tab 14 and then continuing on by pulling tab 14 in the direction of the center, the partial breaking of peripheral line of weakness 22 and the peeling of liner 2 at the nonadhesive or weakly adhesive zone 19 are also started, and only annular projections 10 and 11 and concave channel 12 used to seal the liner remain shell 1.

Figure 7:
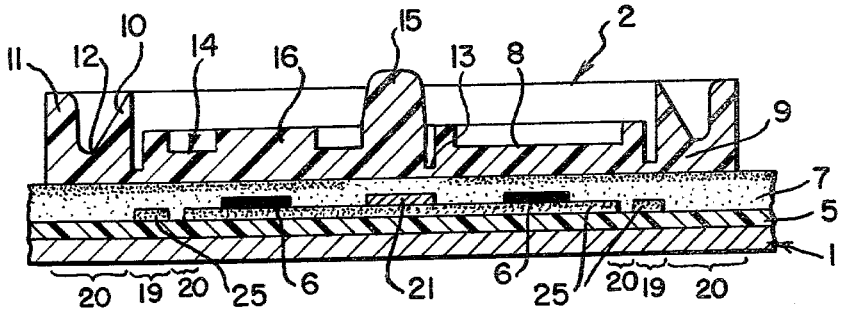
FIGS. 7 and 8 are enlarged partial cross-sectional views through the center-line of the container cover of the type shown in FIG. 6 but with different paint coating constructions configurations of the peelably adhesive interface between the liner and the inside portion of the container cover shell.

In FIG. 7, which shows still another embodiment of the container closure of the present invention, protective undercoating layer 5 is applied to the inner surface of metal container closure shell 1. On this undercoating layer 5 is provided first coat layer 25 which is a polyethylene oxide or acid denatured olefin resin dispersed in a coat-forming base resin. This first coat layer 25 is applied across the entire inner surface of shell 1 corresponding to the olefin resin liner 2 which is to be peeled off, but excludes part 20 that is to be strongly adhesive. In the part corresponding to liner knob 15 on first coat layer 25, there is provided masking layer 21 containing a distribution control agent such as the aforementioned oily resins, and print layer 6 showing the prize markings is also provided. When this first coat layer is applied by hot painting, the polyethylene oxide or denatured olefin resin contained in the paint is distributed preferentially on its surface. Next, on top of this, a second coat layer 7 comprising polyethylene oxide or acid denatured olefin resin dispersed in an adhesive coat forming base resin is applied. On top of this, a molten olefin resin is extruded and press formed to make liner 2. In view of the fact that the polyethylene oxide and acid denatured olefin resin will distribute preferentially on the surfaces of first coat layer 25 and second (adhesive) coat layer 7, a peelably strong adhesion is attained between first coat layer 25 and second coat layer 7, and a considerably firmer adhesion is made between second coat layer 7 and olefin resin liner 2. Also, because polyethylene oxide and acid denatured olefin resin are not interposed in the interface of undercoating 5 and coat layer 7 inside of outer peripheral weakly adhesive zone 19, a peelable, strongly adhesive zone 20 is formed, and further, because the distribution of polyethylene oxide and acid denatured olefin resin on the surface of this coat layer 7 is inhibited by masking layer 21 in the part of second coat layer 7 that corresponds to knob 15 of liner 2, a nonadhesive or weakly adhesive zone is formed between layer 7 and olefin resin liner 2.

Thus, upon peeling the liner 2 of this container cover, when knob 15 falls to one side, peeling between liner 2 and adhesive paint layer 7 occurs first, and then as knob 15 is pulled in a radial direction toward the outer periphery, breaking of adhesive layer 7 occurs first followed by peeling between adhesive layer 7 and first coat layer 25, as tab 14 is pulled off.

Then, when tab 14 is grasped and the entire liner 2 is pulled, interlayer peeling proceeds in nonadhesive or weakly adhesive zone 19 at the interface between layer 7 and layer 25 which zone corresponds to the farthest outward part of the liner to be peeled. Peeling continues through peeling and breaking at strongly adhesive zone 20 in the interface between adhesive layer 7 and primer layer 5, the entire body of liner 2 being peeled off. Print layer 6 adheres to liner 2 together with the second coat layer 7.

Figure 8:
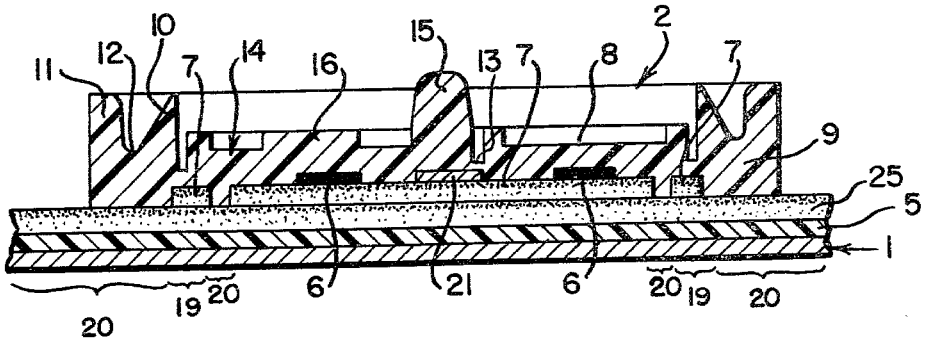

Instead of applying the first (overcoating) layer 25 partially and applying the second (adhesive) coat layer 7 continuously as shown in FIG. 7, it is possible to apply the first coat layer continuously and the second coat layer partially as shown in FIG. 8.

In this case, second coat layer 7 is missing in the parts corresponding to strongly adhesive zone 20, and the olefin resin that makes up liner 2 forms a strongly adhesive zone by directly joining with first coat layer 25 where the polyethylene oxide and denatured olefin resin are dispersed preferentially on the surface part, while on the other hand a non-adhesive or weakly adhesive zone 19 is formed in the same manner as in FIG. 7 in the interface between first coat layer 25 and second coat layer 7.

The invention will now be further illustrated by way of the following examples, wherein parts and percentages are by weight unless otherwise indicated.

EXAMPLE 1

After forming a base coat layer (epoxyamino paint), printing and forming an overcoating layer (epoxyester paint) on one side (the surface intended to be the outer surface of the crown) of surface treated steel sheet (sold by Toyo Kohan Kaisha, Ltd. under the name "HAI-TOPPU") 0.25 mm in thickness, and after roll-coating a paint comprising 70 parts of vinyl chloride-vinyl acetate copolymer, 25 parts of molecular weight 370 bisphenol type epoxy resin, and 5 parts of amino resin (butylated urea resin), together with an organic solvent as an antirust undercoating lacquer, on the other side (the surface intended to be the inner surface of the crown) to a thickness of 3 microns after hardening and drying, heating was carried out at 190° C. for 10 minutes. Over this antirust undercoating, a masking composition comprising 80 parts of linseed oil denatured alkyd resin, 2 parts of manganese naphthenate, 30 parts of alumina and 10 parts of kerosene was painted to a thickness of 2 microns in six separate zones as concentric circles, the painting in the zones being in the form of a network of points, or painting over the entire surface, or not painting at all, the zones including a zone of diameters ranging from 25 mm to 20 mm (hereafter called Zone 1), a zone of diameters from 20 mm to 15 mm (hereafter called Zone 2), a zone of diameters from 15 mm to 10 mm (hereafter called Zone 3), a zone of diameters from 10 mm to 5 mm (hereafter called Zone 4), a zone of diameters from 5 mm to 2 mm (hereafter called Zone 5), and a zone comprising a circle 2 mm in diameter (hereinafter called Zone 6), the center-to-center distance between adjoining points in the networks being 0.5 mm, the point network painting being done in various concentrations as shown by the ratios of painted area to the total area of the zone painted with points, thus forming the various types of masking layers presented in Table 1.

TABLE I

| Sample No. | Masking Layers 25-20 (%) | 20-15 (%) | (Zones: Outer Diameter mm Inner Diameter mm)* 15-10 (%) | 10-5 (%) | 5-2 (%) | 2-0 (%) | Crown Producibility | Liner Adhesive Retention | Sealability | Liner Peelability |
|---|---|---|---|---|---|---|---|---|---|---|
| 1 | 0 | 0 | 0 | 0 | 0 | 0 | good | good | good | poor |
| 2 | 50 | 50 | 50 | 50 | 50 | 50 | good | good | good | poor |
| 3 | 80 | 80 | 80 | 80 | 80 | 80 | good | poor | poor | good |
| 4 | 100 | 100 | 100 | 100 | 100 | 100 | poor | poor | poor | very good |
| 5 | 50 | 100 | 100 | 100 | 100 | 100 | fair | good | poor | poor |
| 6 | 100 | 50 | 50 | 50 | 50 | 50 | very good | good | good | good |
| 7 | 100 | 50 | 100 | 100 | 100 | 100 | good | good | good | very good |
| 8 | 100 | 50 | 100 | 50 | 100 | 50 | very good | good | good | good |
| 9 | 100 | 0 | 100 | 100 | 100 | 50 | very good | good | good | good |
| 10 | 100 | 0 | 100 | 50 | 100 | 100 | good | good | good | good |
| 11 | 80 | 50 | 100 | 100 | 100 | 80 | good | good | good | very good |
| 12 | 80 | 50 | 100 | 80 | 100 | 80 | very good | good | good | good |
| 13 | 100 | 50 | 100 | 100 | 100 | 80 | good | good | good | very good |

*Masking layer (%) indicates masking concentration, 0% meaning no masking layer was painted at all, and 100% meaning the entire surface was painted.

Next, a primer layer is applied over the masking and anti-rust undercoating lacquer layers. For this purpose, a primer paint having a total solids content of 30 percent is formulated from 40 parts phenolic resin (made by reacting 1.0 mole of p-cresol, 1.2 mole of formaldehyde, and 0.2 mole of ammonia), 60 parts of bis-phenol A type epoxy resin (sold by Shell Chemical under the trademark Epikote 1007), 8 parts of polyethylene functionalized with 30.5 meq/100 grams of maleic anhydride and having a degree of crystallinity of 74.9%, and an organic solvent vehicle comprising methylethyl ketone, methyliso-butyl ketone and xylene. The primer is then roller coated to a cured (after heating at 190° C. for 10 minutes) thickness of 6 microns.

The thus-painted sheet was press formed into the shape of crowns (26 mm inner diameter) with the primer layer surface on the inside of the crowns and the centers of the concentrically applied masking layers coincident with the centers of the crowns, to make crown seals having these various types of masking layers on their inner surfaces. On the inner surface of each preheated crown seal, polyethylene (melt index 7, density 0.91) was melt extruded from a 40 mm diameter extruder having a 5 mm diameter nozzle, and about 250 mg of the molten material was cut off with a cutting knife at the nozzle tip. Punching was done with a cooled punch, and the crown was thereby lined with a polyethylene liner having two continuous convex annular projections (height 1.5 mm) for sealing whose outer diameter was 24 mm; from the 24 mm diameter position to the 19 mm diameter position, the thickness of the interval (valley) between the two annular projections was 0.3 mm, the inside from the 19 mm diameter position was a relatively thin part 0.2 mm thick, there was a single conical shaped knob with a truncated head (bottom surface diameter 3 mm, height 4 mm, upper surface diameter 2 mm) demarcated by a line of weakness (0.5 mm wide, 0.01 mm thick) connecting from the center of the thin inside part to the inner annular projection (furnished so that the contact line extended from the lower outer peripheral surface of the knob to two points separated at an interval of 6 mm on the inside periphery of the inner annular projection), and the inside of this line of weakness had a reinforcing rib 0.5 mm wide and 1 mm high.

The producibility of these crowns (performance during punching), their liner adhesive retention (retention of the liner during hoppering after standing for one month at room temperature), their sealability (evaluated by the JIS S-9017 continuous pressure resistance test), and their liner peelability (ease of liner peeling from the opened crown after it had been attached to the glass bottle) are shown in Table 1.

The foregoing results show that with the crowns of the present invention (samples 6 through 13), the liners are all weakly adhesive in their farthest peripheries, and are thus capable of being peeled off from the crowns easily and in their entirety, despite the fact that their insides are weakly adhesive, by laterally pressing the knob with a finger and then grasping the tab and pulling upward. With the crowns made according to the prior art (Samples 1 and 5), when the farthest extremities of the liners are weakly adhesive, it is difficult to peel the entire liner off from the crown seal, and when the adhesion is sufficiently weak to permit easy peeling, then imperfect sealing is found.

EXAMPLE 2

On top of an antirust undercoating lacquer layer formed on surface treated steel sheet 0.25 mm thick obtained in the same manner as described in Example 1, a first coating layer having 30% total solids was applied comprising 70 parts of Epikote 1007 epoxy resin, 20 parts of phenolic resin (sold by Hitachi Chemical Company under the trademark Hitanoru 2080), 10 parts of polyethylene oxide (density 1.0, softening point 135° C., total oxygen concentration 4.3%), and an organic solvent vehicle comprising a mixture of xylene and Butyl Cellosolve). This application of the first coating layer was in circular parts 26 mm in diameter to a cured (by heating at 200° C. for 10 minutes) thickness of 5 microns. Three circular parts each 1 mm in diameter and positioned at equal intervals from the center of the 26 mm diameter circle to the 10 mm radial perimeter were not painted.

Next, a design (prize marking) was printed in the region outside the central 6 mm-diameter circular portion of the first coating layer, using a metal printing ink comprising rosin denatured alkyd resin (vehicle), phthalocyanine blue (pigment), manganese chloride (drier) and kerosene (solvent), and after heating for 10 minutes at 150° C., the same composition as in the foregoing Example 1 was applied as a masking layer to a thickness of 3 microns in the circular part 5 mm in diameter having the same center as the first coating layer. Further, on top of the antirust undercoating lacquer layer, the first coating layer, the prize marking, and the masking layer, there was applied a second coating layer of the same paint composition as the first coating layer over the entire surface by roller coating to a cured (by heating at 200° C. for 10 minutes) thickness of 2 microns to make a two-surface printed coated sheet.

This printed coated sheet had the prize mark printed surface on the inside, and the circular parts of the circularly applied first coating layer were formed on the crown seal (inner diameter 26 mm) with a crown forming press conforming to the peripheral edge part of the crown inner surface. Low density polyethylene (melt index 3.5, density 0.92) sufficiently colored with titanium oxide and carbon black so that the prize marking on the inside of the crown seal would not show through was extrusion punched in the same manner as in Example 1, to make a crown with a polyethylene liner having the same shape as in Example 1.

In peeling the liners from the crowns thus obtained, because there was a masking layer beneath the knob in the center of the liner, the liner and the second coating layer were weakly adhesive, so that the knob could be easily peeled off, and by grasping the knob and pulling it up, since the liner and second coating layer, and the second coating layer and the prize marking were firmly attached in the parts where there was no masking layer, it was possible to peel easily between the weakly adhesive first coating layer and second coating layer and mark. Also, though the liner and the second coating layer as well as the second coating layer and the antirust undercoating were firmly adhered at the three circular parts where no first coating layer was applied, since the adhesive area was small, the adhesive interface between the second coating layer and the liner could be easily broken, and the liner could be peeled from the crown.

The prize marking was transfered to the inside of the peeled liner.

EXAMPLE 3

As a first coating layer on the antirust undercoating lacquer layer formed on surface treated steel sheet 0.25 mm thick obtained in the same manner as in Example 1, the same paint composition used in Example 2 was roller coated over the entire surface to a cured (after heating at 200° C. for 10 minutes) thickness of 5 microns. A design was printed with the metal printing ink used in Example 1 as a prize marking in a ring shaped zone (outer diameter 9 mm, inner diameter 6 mm) on this first coated layer, and heating was carried out at 200° C. for 10 minutes.

Then the same masking composition as in Example 1 was painted to a thickness of 3 microns on a circular part 5 mm in diameter with the same center as the said ring-shaped zone on the first coating layer. Further, on the circular part 26 mm in diameter having the same center as the masking layer, and over the first coating layer, the prize marking and the masking layer (however, excluding three 1 mm diameter circular parts positioned at equal intervals in the 10 mm radial periphery from the center of the circular part 26 mm in diameter), there was provided a dual surface printed coating sheet as a second coating sheet, painted to a thickness of 2 microns after drying and hardening with the painting composition used as the said first coating layer, and then heating was done at 200° C. for 10 minutes.

This printed coating sheet had the prize marking printing layer on its inside, and the peripheral part of the second coating sheet applied circularly was formed as a crown seal (inner diameter 26 mm) with a crown forming press so as to conform to the peripheral edge of the crown seal inner surface. On the inner surface of this crown seal, in the same manner as in Example 2, a crown was formed lined with a non-transparent polyethylene liner.

When the liner was peeled from the crown thus obtained, since the liner and the second coating layer were weakly adhered due to the fact that there was a masking layer underneath the knob in the center of the liner, the knob could be easily peeled off, and further, since the liner and the second coating layer as well as the second coating layer and the prize marking were firmly adhered in the parts where there was no masking layer, by grasping the knob and pulling up the tab, it was easy to effect peeling between the weakly adhesive first coating layer and the second coating layer with the prize marking. Also, although the liner and the first coating layer as well as the first coating layer and the antirust undercoating were firmly adhered at the three circular parts where the second coating layer has not been applied, since the adhesive surface was small, it was possible to destroy the adhesive interface between the first coating layer and the liner easily, to peel off the liner from the crown.

The prize marking was transferred to the inside of the peeled liner.

EXAMPLE 4

A masking layer and coating layer were formed in the same manner as in Example 2, but without applying the prize marking on the antirust undercoating lacquer layer and first coating layer, these having been formed on surface treated steel sheet 0.25 mm thick obtained by repeating the operations in the same manner as in Example 2. Letters were printed with the same metal printing ink used in Example 2, to serve as the prize marking, in the parts corresponding to the first coating layer on the second coating layer, and in the parts not corresponding to the masking layer, followed by heating at 170° C. for 10 minutes, to make a dual surface printed coated sheet.

This printed coated sheet was formed into a crown seal (inner diameter 26 mm) such that the prize marking printed surface was on the inside, and the periphery of the first coated layer applied circularly conformed to the peripheral edge part of the crown seal inner surface. By repeating the process of Example 2, a crown lined with polyethylene liner was made on the inner surface of this crown seal.

When the liner was peeled from the crown thus obtained, it was possible to peel the liner easily from the crown in the same manner as in Example 2. Also, the prize marking was transferred to the inside of the peeled liner.

EXAMPLE 5

Letters were printed with the metal printing ink used for the prize marking in Example 2, in the parts corresponding to the masking layer on top of the primer layer of the coating sheet of the same paint layer composition as Sample No. 12 of Example 1, obtained in the same manner as in Example 1, heating was done at 170° C. for 10 minutes, and a dual surface printed coated sheet was made. This printed coated sheet was formed on the crown seal in the same manner as in Example 1 so that the prize marking printed surface was on the inside, and then a crown interiorly lined with non-transparent polyethylene was formed in the same manner as in Example 2. When the liner was peeled from the crown thus obtained, it was possible to read the prize marking on the inner surface of the crown seal, that had been hidden by the nontransparent liner.

EXAMPLE 6

A masking layer of the same shape as Sample No. 12 in Example 1 was formed, using the same masking agent composition as in Example 1, over a prize marking printed on one surface of tinplate 0.27 mm thick and then dried. Then, the paint used as the primer layer in Example 1 was roller coated to a thickness of 6 microns after drying and hardening, to serve as the primer layer over this prize marking and masking layer, after which heating was carried out for 10 minutes at 200° C., to make a printed coating sheet. This printed coating sheet was formed on the crown seal with the prize marking printed surface on the inside and with the center of the crown identical to the center of the circularly applied masking layer, after which a crown was made lined with a non-transparent polyethylene liner in the same manner as in Example 2. When the liner was peeled from the crown, it became possible to see the prize marking on the inner surface of the crown seal that had been hidden by the non-transparent liner.

EXAMPLE 7

On surface treated steel sheet 0.3 mm thick, and over an antirust undercoating lacquer layer formed in the same manner as Example 1, a pattern serving as the prize marking was applied by offset printing with the ink being distributed over nearly the entire surface in a circular area 25 mm in diameter, by means of a process flat plate (using a halftone plate with 150 lines per inch), using three types of printing ink made of a base resin solution comprising 60 parts by weight of soybean denatured alkyd resin, 2 parts by weight of manganese naphthenate, 5 parts by weight of alumina and 12 parts by weight of kerosene, into which were blended respectively in amounts of 25 parts by weight each the pigments phthalocyanine blue (blue color), "Fanal" color (red color) and benzidine yellow (yellow color), followed by heating at 150° C. for 10 minutes. Then, masking layers were applied over the prize marking, using the same masking agent composition as in Example 1 at the same center identical to the center of the prize marking, in a network of points as in Example 1, but with the masking concentration at 20% in the 1st zone, 10% in the 2nd zone, 20% in the 3rd, 4th and 5th zones, and 5% in the 6th zone.

Then, over this antirust undercoating lacquer layer, prize marking and masking layer, the primer paint used in Example 1 was roller coated to a thickness of 6 microns after drying and hardening, and it was heated at 200° C. for 10 minutes to make a printed coated sheet.

This printed coated sheet was made into a crown lined with a non-transparent polyethylene liner in the same manner as in Example 2, on the inner surface of a crown seal formed so that the prize marking was on the inside, as in Example 1. The liner was readily peeled from the crown by hand without using any implement, whereupon it was possible to see the prize design hidden by the non-transparent liner. In this crown, because the masking agent composition served as a distribution control against the denatured polyethylene, the adhesive strength toward the polyethylene liner of the primer layer surface corresponding to the parts where the masking layers were present was weakened, and in addition to this, since the layer of printing ink also functioned as a distribution control agent against the denatured polyethylene (the distribution control effect was less than the masking agent composition), the distribution state of the denatured polyethylene on the crown seal inner surface was finely controlled. This was also apparent from the fact that the transferred denatured polyethylene appeared white on the inside of the peeled liner.

EXAMPLE 8

An aluminum sheet 0.25 mm thick and pretreated on one side with a coating (vinyl paint) was printed on the noncoated side with characters explaining the method of prize winning inside a zone 38 mm in diameter using metal printing ink. On top of this the paint used as the antirust undercoating lacquer in Example 1 was roller coated as a vinyl chloride liner adhesive paint layer over the entire surface to a thickness of 5 microns after drying to hardness, and heating was done at 190° C. for 10 minutes.

Then, to serve as a masking layer in concentric circles in the parts corresponding to the printed zones on the liner adhesive paint layer, the same masking agent composition as in Example 1 was applied to a thickness of 3 microns over the entire areas in the zones from 30 mm diameter to 23 mm, 21 mm to 8 mm and 6 mm to 2 mm, and as a point network inside 23 mm diameter to 21 mm, from 8 mm to 6 mm and inside 2 mm diameter (resolution, 120 lines/inch, masking concentration 80%), and heating was done at 150° C. for 10 minutes. Then, on top of this masking layer, a prize marking constituting a certificate of purchase for bottled goods was printed, using ink comprising 50 parts by weight of emulsion type vinyl chloride resin, 45 parts by weight epoxized soybean oil, 15 parts by weight of rosin ester and 20 parts by weight of phthalocyanine blue, after which heating was done at 150° C. for 5 minutes to make a printed coating sheet having two printing layers. This printed coating sheet was punched out in cylinders such that the printing surface was on the inner surface and the center of the print part corresponded with the center of the cap top part, after which it went through a perforation cutting process to make a roll on pilferproof cap seal of 38 mm inner diameter and 30 mm high.

To serve as liner material for the inner surface of this cap seal, a sol composition comprising 100 parts by weight of vinyl chloride resin, 80 parts by weight of dioctyl phthalate and 5 parts by weight of carbon black was formed by hot embossing, and a cap was made lined with a nontransparent vinyl chloride liner having an outer diameter of 35 mm, an annular projection (2 mm high) for sealing in the place from 35 mm diameter to 30 mm, having an annular thick part 1 mm high and 3 mm wide bordered by a 1st line of weakness (1 mm wide, 0.005 mm deep) on the inside of this annular projection, inside of this annular thick part there was a thin part 0.3 mm thick, having a single tab demarcated by a second line of weakness (1 mm wide, 0.01 mm thick) made so as to connect from the center of the thin part to the inside of the annular thick part (this had a cylindrical knob with the same center as the thin part and 4 mm in diameter and 5 mm high, with a contact line extending from the periphery of this knob to the inner periphery of the annular thick part in two ends separated there by 7 mm), and the tab had the inside of the second line of weakness reinforced by a rib 1 mm high and 1 mm wide.

This cap was opened after being applied by roll-on to a glass bottle containing a carbonated beverage (having a gas pressure of 4 kg/cm$^2$ at 15° C.). When the liner was peeled from the opened cap, the falling of the knob cut a part of the second line of weakness, grasping the knob and pulling it completely cut the second line of weakness, then going on to pull up the thick part connected to the tab cut the first line of weakness, so that only the inside of the first line of weakness was taken off, leaving the annular projection for sealing.

The prize marking was transferred to the peeled liner, while the rules were shown on the inside of the cap seal from which the liner piece was removed. Also, the sealing annular projection on the liner remained firmly adhered to the inner surface of the crown.

The preceding examples were presented for the purpose of illustrating without limitation the product of the invention and the advantages thereof. It is understood that changes and variations can be made therein without departing from the scope of the invention which is defined in the following claims.

I claim:

1. A container closure for use in packaging flowable materials, comprising:

a closure shell;

a peelable thermoplastic olefin resin liner disposed on the inner surface of the shell and having a thick periphery and a comparatively thin central portion with a demarcated peeling tab extending to the periphery of the liner;

at least one adhesive interfacial layer containing an acid-modified olefin resin and separating the liner from and peelably bonding said liner to the shell and having a non-adhesive or weakly adhesive zone underlying and corresponding to the periphery of the liner and a relatively strongly adhesive zone underlying and corresponding to the central portion of the liner; and a masking layer disposed in contact with the adhesive layer and containing a composition to control the distribution of the modified olefin resin within the adhesive layer.

2. A container closure according to claim 1 wherein:

the shell is fabricated of metal sheet material having a protective undercoating; and the liner is applied to the inner surface of the shell by press-forming a moldable thermoplastic olefin resin; and the composition used to control the distribution of the modified olefin resin within the adhesive layer is selected from the group consisting of oil-modified resins, resins having a fatty acid or polymerization resin acid as a constituent, polyalkylene polyols, fatty acid metallic soaps, organosilanes, butadiene paints and epoxy plasticizers.

3. A container closure according to claim 1 wherein:

the shell is fabricated of surface-treated sheet steel having a protective undercoating;

the liner is applied to the inner surface of the shell by press-forming a moldable thermoplastic olefin resin; and the adhesive layer is a coating of polyethylene oxide and acid-modified olefin resin dispersed in a coat-forming base resin; and the composition used to control the distribution of the modified olefin resin within the adhesive layer is employed in an amount between 1 and 500 $mg/dm^2$.

4. A container closure according to claim 3 wherein the concentration of polyethylene oxide and modified olefin resin in the adhesive layer provide between about 0.1 and about 200 milliequivalents of carbonyl radical per 100 g of total polymer, and the degree of crystallinity in said layer is at least about 50%;

the ratio of the coat-forming base resin concentration to the concentration of modified olefin resin is at least about 1.1; and the weight ratio of polyethylene oxide and modified olefin resin to coat-forming base resin is between 0.2:99.8 and 70:30.

5. A container closure according to claim 1 wherein:

the shell is fabricated of surface-treated sheet steel having a protective undercoating;

the liner is applied to the inner surface of the shell by press-forming a moldable thermoplastic vinyl chloride resin;

the adhesive layer is a coating derived from a combination of vinyl chloride resin or acrylic resin with a thermoplastic epoxy resin, phenolic resin, amino resin, or alkyd resin.

6. A container closure according to claim 5 wherein the weight ratio of vinyl chloride resin or acrylic resin to thermoplastic polymer is between 30:70 and 98:2.

7. A container closure according to claim 1 wherein:

at least one part of the thick periphery of the liner is an annular projection adapted for sealing engagement with the mouth of the container; and the peeling tab has at least one reinforcing rib extending along the tab to periphery of the liner, and a knob for peeling disposed in the vicinity of the inner end of the tab.

8. A container closure according to claim 1 wherein the adhesive layer is distributed as a network of points.

9. A container closure according to claim 1 wherein the adhesive layer is distributed as a continuous layer.

10. A container closure according to claim 1 wherein a printed message layer is disposed between the liner and the adhesive layer.

* * * * *

UNITED STATES PATENT AND TRADEMARK OFFICE

CERTIFICATE OF CORRECTION

PATENT NO. :4,253,580

DATED :March 3, 1981

INVENTOR(S) :KOICHI DOI; FUMIO MORI; ISAO ICHINOSE; TETSUOMI OGIMOTO; and KATSUHIKO KITAKAWA It is certified that error appears in the above—identified patent and that said Letters Patent is hereby corrected as shown below:

Title page (containing "ABSTRACT", etc.), left-hand column, after "[22] Filed Aug. 17, 1979" insert -- [30] FOREIGN APPLICATION PRIORITY DATA August 22, 1978 JAPAN 53-101463 -- .

Column 3, line 41, "azo-bisisobutyronitrile" should read -- azo-bis-isobutyronitrile -- .

Column 3, lines 41-42, "oxy-bisbenzenesulfonyl" should read -- oxy-bis-benzenesulfonyl -- .

Column 6, line 7, "oil-dentured" should read -- oil-denatured -- .

Column 11, line 40, "the distributed" should read -- the distribution -- .

Column 12, line 32, "points of" should read -- points on -- .

Signed and Sealed this

Seventh Day of July 1981

[SEAL]

Attest:

RENE D. TEGTMEYER

Attesting Officer

Acting Commissioner of Patents and Trademarks